US006027803A

United States Patent [19]

Jacobson et al.

[11] Patent Number: 6,027,803

[45] Date of Patent: Feb. 22, 2000

[54] SPANDEX CONTAINING BARIUM SULFATE

[75] Inventors: Howard Wayne Jacobson, Wilmington, Del.; Charles William Goodrich, Waynesboro, Va.

[73] Assignee: E. I. du Pont de Nemours and Company, Wilmington, Del.

[21] Appl. No.: 09/203,690

[22] Filed: Dec. 2, 1998

Related U.S. Application Data

[63] Continuation-in-part of application No. 08/853,777, May 9, 1997, abandoned, which is a continuation of application No. 08/413,881, Mar. 10, 1995, abandoned, which is a continuation-in-part of application No. 08/075,702, Jun. 11, 1993, abandoned.

[51] Int. Cl.[7] ..... D02G 3/00; D01F 6/00

[52] U.S. Cl. ..... 428/372; 428/375; 428/394; 264/211.1

[58] Field of Search ..... 428/372, 375, 428/394; 264/211.1

[56] References Cited

U.S. PATENT DOCUMENTS

| | | | |
|---|---|---|---|
| 3,039,895 | 6/1962 | Yuk | 117/138.8 |
| 3,296,063 | 1/1967 | Chandler | 161/175 |
| 3,386,942 | 6/1968 | Bell et al. | 260/37 |
| 4,296,174 | 10/1981 | Hanzel et al. | 428/329 |
| 4,525,420 | 6/1985 | Imai et al. | 428/372 |
| 4,525,520 | 6/1985 | Imai et al. . | |
| 5,180,585 | 1/1993 | Jacobson et al. | 424/405 |
| 5,183,614 | 2/1993 | Champion | 264/184 |
| 5,595,750 | 1/1997 | Jacobson et al. | 424/421 |

FOREIGN PATENT DOCUMENTS

| | | | |
|---|---|---|---|
| 0 380 344 | 1/1990 | European Pat. Off. | D01F 1/10 |

OTHER PUBLICATIONS

Kirk–Othmer, Barium Sulfate, *Encyclopedia of Chemical Technology*, vol. 3, 3rd Edition, John Wiley & Sons, New York, pp. 473–476, 1978.

*Primary Examiner*—William Krynski
*Assistant Examiner*—J. M. Gray
*Attorney, Agent, or Firm*—George A. Frank

[57] ABSTRACT

Low tack dry-spun spandex containing barium sulfate of low isoelectric point is provided.

7 Claims, 4 Drawing Sheets

SPANDEX CONTAINING BARIUM SULFATE

REFERENCE TO RELATED APPLICATIONS

This is a continuation-in-part of application Ser. No. 08/853,777, filed May 9, 1997, now abandoned, which was a continuation of application Ser. No. 08/413,881, filed Mar. 10, 1995, now abandoned, which, in turn, was a continuation-in-part of application Ser. No. 08/075,702, filed Jun. 11, 1993, now abandoned.

BACKGROUND OF THE INVENTION

1. Field of the Invention

The present invention relates to spandex in which particles of barium sulfate are dispersed and, more specifically, to spandex wherein the barium sulfate particles have a very low isoelectric point.

2. Description of the Prior Art

Spandex is known to exhibit considerable tackiness compared to conventional non-elastomeric textile fibers. The filaments tend to stick to various surfaces and to each other, especially when wound up on a bobbin. Tackiness can cause excessive unwinding tension (referred to hereinafter as "take-off tension") as well as frequent, large transients in the tension as the spandex is unwound from the package. Excessive take-off tensions and transients can cause yarn breaks during handling, fabric defects and other manufacturing difficulties, especially in making of knit fabrics.

To reduce spandex tackiness, lubricating finishes and other materials have been applied to spandex and/or dispersed within the spandex. Examples of such lubricating finishes include metallic soaps dispersed in textile oils (Yuk, U.S. Pat. No. 3,039,895) and polyalkylsiloxanes (Chandler, U.S. Pat. No. 3,296,063). The dispersion of certain metal soaps (e.g., stearates of calcium, magnesium or lithium) within the spandex for tackiness reduction is disclosed by Hanzel et al, U.S. Pat. No. 4,296,174.

Imai et al, U.S. Pat. No. 4,525,420, disclose the use of inorganic fillers, including barium sulfate, having a refractive index of $\leqq 1.75$, to improve the spinning properties and light and chlorine resistance of polyurethane elastic yarn. The spinning properties are said to be improved because filament breakage is decreased through the prevention of turbulence and melt adhesion of the filaments in the spinning tube.

SUMMARY OF THE INVENTION

The spandex of this invention has a lubricating finish on its surface and barium sulfate particles dispersed within its volume, wherein the barium sulfate particles have an isoelectric point of 0–4 and a mean particle size of 0.7–1.0 micron.

BRIEF DESCRIPTION OF THE DRAWINGS

Each of FIGS. 1–6 is a scanning electron micrograph of spandex containing barium sulfate particles.

DETAILED DESCRIPTION OF THE INVENTION

Figure 1:
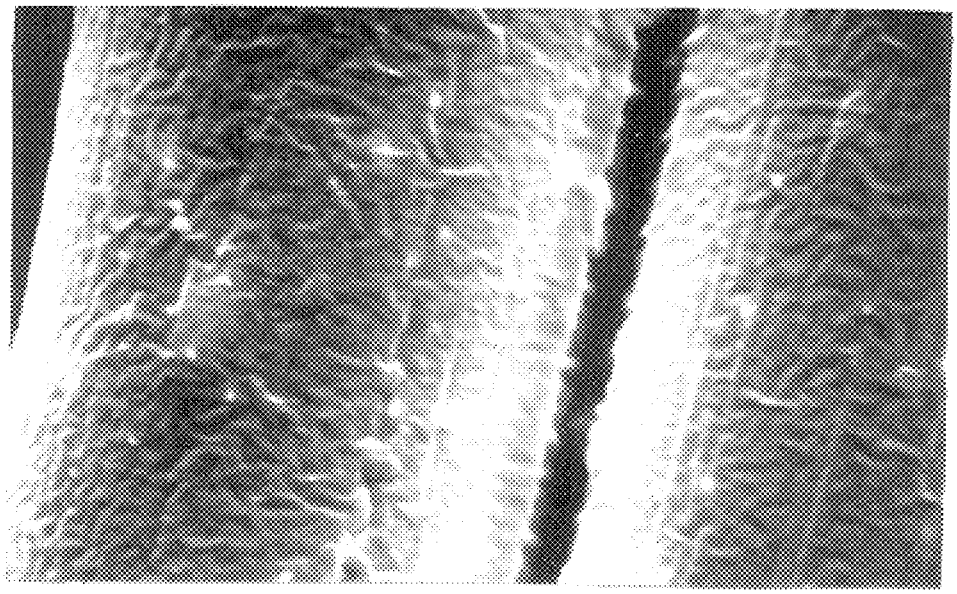
In FIGS. 1 and 2, spandex in accordance with the invention exhibits very rough surface. In contrast, as shown by FIGS. 3–7, the surface character of the spandex containing barium sulfate particles that are not according to the invention, or containing no barium sulfate particles at all, is relatively smooth.
Figure 2:
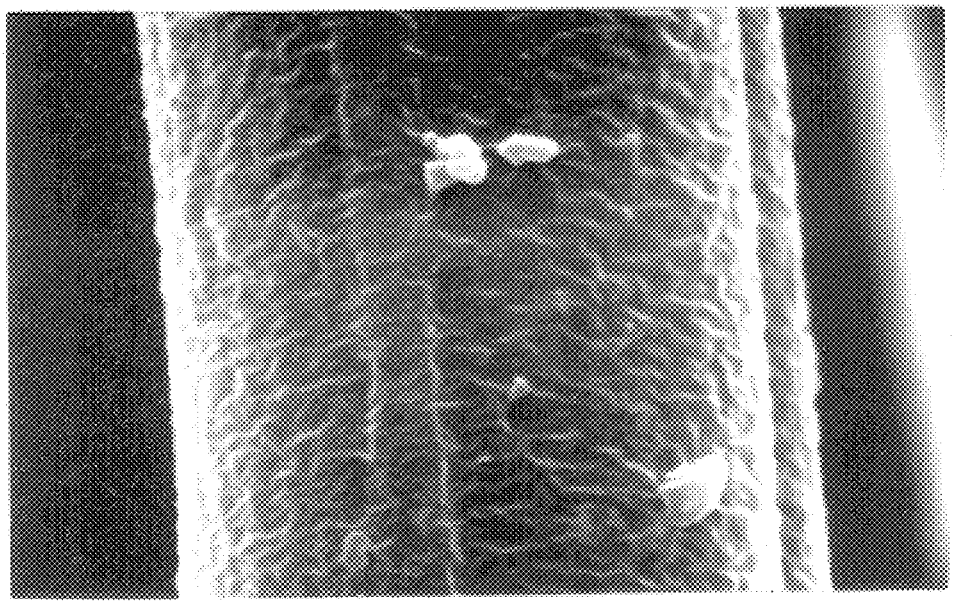
Figure 3:
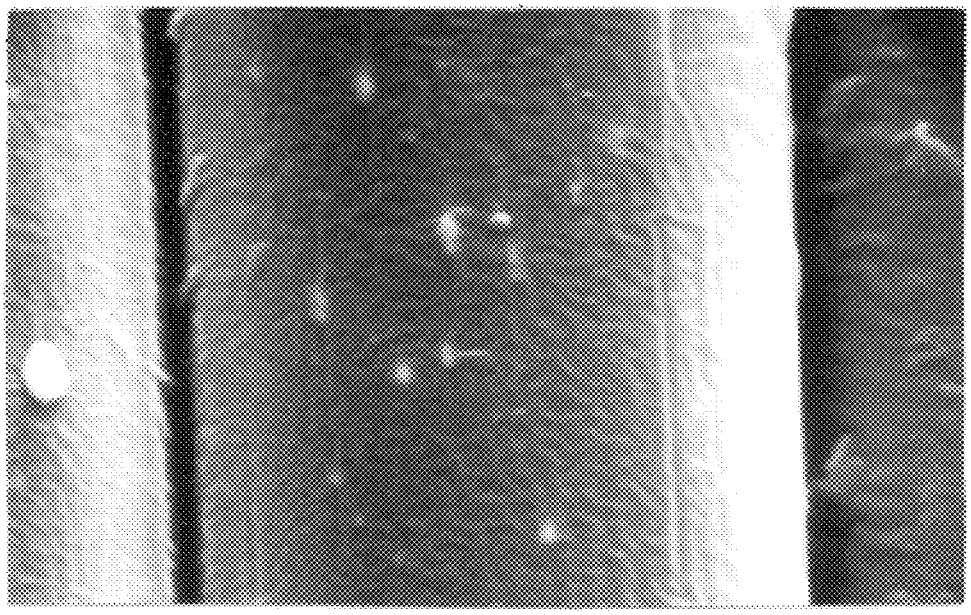
Figure 4:
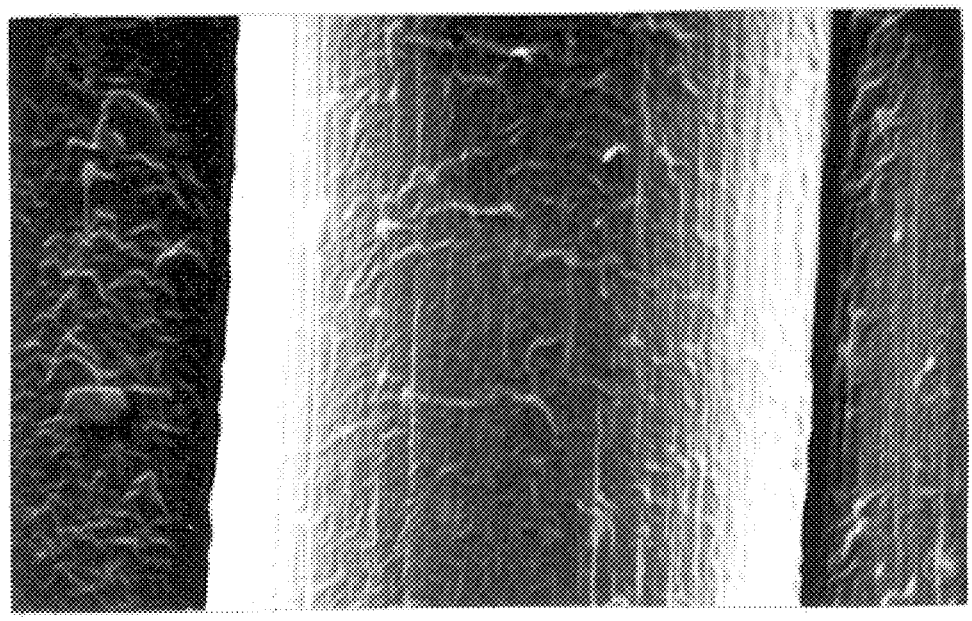
Figure 5:
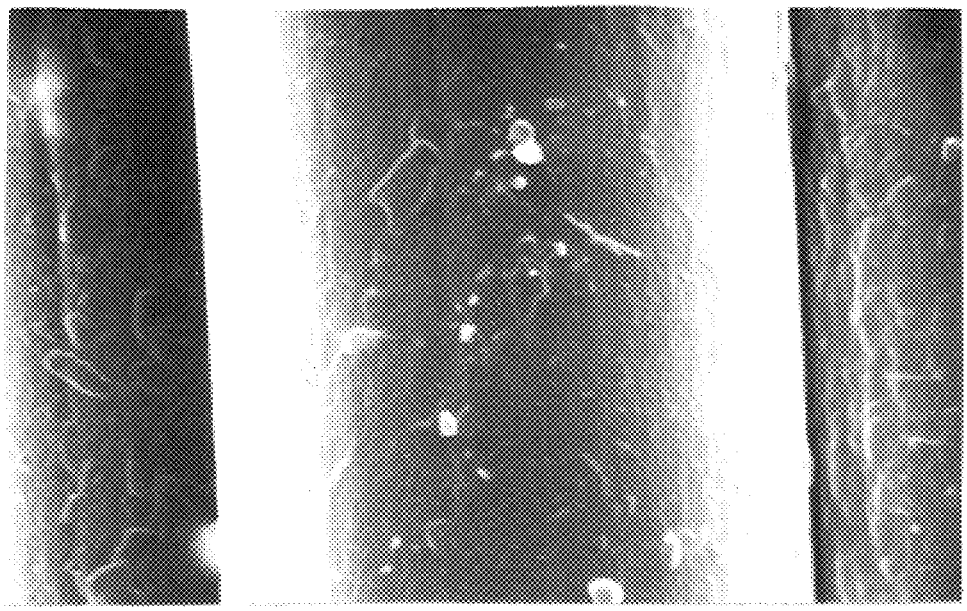
Figure 6:
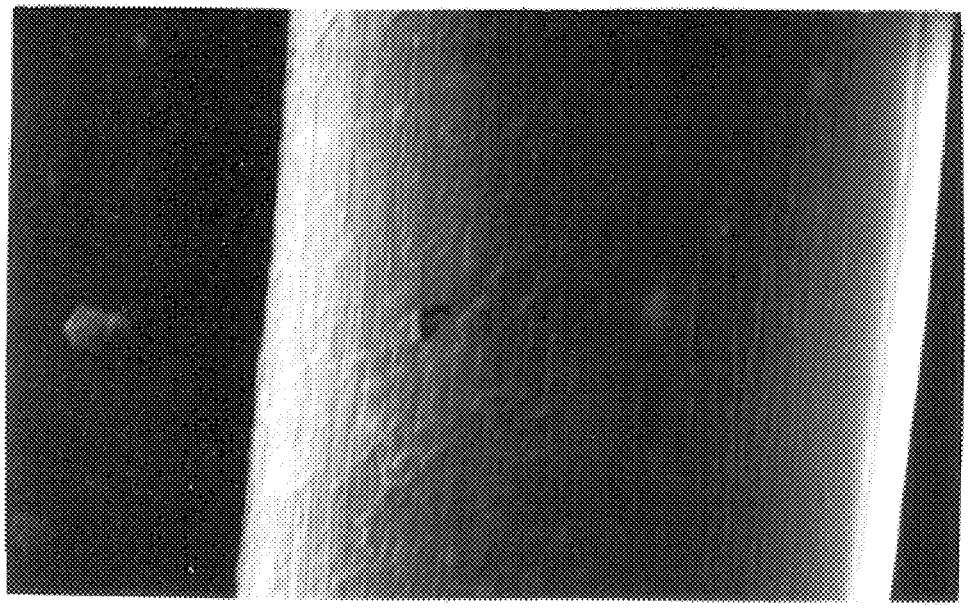

As used herein, the term "spandex" has its usual definition; that is, a manufactured fiber in which the fiber-forming substance is a long chain synthetic elastomer composed of at least 85% by weight of a segmented polyurethane. The term "fiber" includes in its meaning staple fibers and continuous filaments.

For convenience, in the discussion and examples that are presented below, the following abbreviations can be used for the accompanying term:

| | |
|---|---|
| Poly (tetramethyleneether) glycol | PO4G |
| Methylene-bis(4-Phenylisocyanate), also known as p,p'-methylenediphenyldiisocyanate | MDI |
| Isocyanate end group | NCO |
| Ethylenediamine | EDA |
| 2-methyl-1,5-diaminopentane | MPMD |
| N,N-dimethylacetamide solvent | DMAc |
| Diethylamine | DEA |
| 1,3,5-tris(4-t-butyl-3-hydroxy-2,6-dimethyl-benzyl)-1,3,5-triazine-2,4,6(1H,3H,5H)trione antioxidant sold by American Cyanamid | "Cyanox" 1790 |
| Copolymer of diisopropylaminoethyl methacrylate and n-decylmethacrylate, also called DIPAM/DM | "Methacrol" 2138 |
| Tenacity, dN/tex | T |
| Elongation at break, % | E |
| Load power on first cycle, dN/tex | |
| Load at 100% elongation | LP-100 |
| Load at 200% elongation | LP-200 |
| Unload power on fifth cycle, dN/tex | |
| Unload at 100% elongation | UP-100 |
| Unload at 200% elongation | UP-200 |
| Over end take-off tension, centiNewtons | OET |

The chemical composition of a polymer of the spandex also can be abbreviated as illustrated by the following example, in which a polyurethaneurea made from poly (tetramethyleneether)glycol ("PO4G") having a number average molecular weight of 1800, methylene-bis (4-phenylisocyanate) ("MDI") and a mixture of ethylene diamine ("EDA") and 2-methyl-1,5-diaminopentane ("MPMD") in a molar ratio of 90 to 10, is abbreviated as PO4G(1800):MDI:EDA/MPMD(90/10).

Colons are used to separate the monomers of the repeating units of the polymer, a slash between the diamines indicates that the diamines are in a mixture and parenthetic numbers immediately following the glycol and diamine mixture, respectively, refer to the number average molecular weight of the glycol and the molar ratio of the diamines in the mixture.

In accordance with the present invention, a spandex has dispersed within its volume barium sulfate particles having an isoelectric point in the range of 0–4, preferably 1–2.5. Conventional techniques can be employed to add the particles to a polyurethane solution from which the spandex is to be dry spun. Generally, the barium sulfate amounts to 0.3–5%, preferably 1–3%, of the total weight of the spandex.

The barium sulfate particles suitable for use in the present invention are small, having a mean particle size of 0.7–1 micron. The average size of the particles is typically in the range of 0.5–3 microns with the largest particles (i.e., not more than 2% of the particle size distribution) being no greater than 25 microns, preferably no greater than 15 microns.

Conventional polymers used for preparing spandex by dry spinning are suitable for the spandex of the present invention. These typically are prepared by known processes in which a polyether-based glycol or polyester-based glycol is reacted with a diisocyanate to form an isocyanate-capped glycol which is then reacted with diamine chain extender to form the segmented polyurethane polymer. Usually, the polymer is dissolved in an inert organic solvent, such as dimethylacetamide (DMAc), dimethylformamide, or N-methyl pyrrolidone. Generally, the pH of the polymer solution is in the range of 9–12. As a result of the low isoelectric point of the barium sulfate particles for use in the invention, the particles are very well dispersed within the solution and subsequently within the spandex.

The polymer solution can be dry-spun in conventional equipment through orifices into a shaft. Heated inert gas can pass through the shaft to assist solvent evaporation from the surface of the formed filament as the filament passes through the shaft. Filaments from multiple orifices can be twisted together to form a multi-filament yarn. Lubricant can be deposited on the surface of the filaments by a conventional finish roll or by being co-spun with the filaments from the polymer solution. Thereafter, the thusly dry-spun filaments (i.e., spandex) are wound up on a cylindrical member to form a yarn supply package (e.g., a pirn, bobbin, cake).

Conventional spandex (i.e., not containing the special barium sulfate particles in accordance with the invention) are quite tacky. Polyether-based spandex usually is more tacky than polyester-based spandex.

Commercial spandex, such as LYCRA®, is well known (a registered trademark of E. I. du Pont de Nemours and Company). Typically, about 0.4–0.7 kilogram of spandex yarn is wound up on the cylindrical tube of such yarn supply packages.

The polymer of the spandex of the invention can contain conventional agents that are added for specific purposes, such as antioxidants, thermal stabilizers, UV stabilizers, titanium dioxides, other pigments, dyes, lubricating agents and the like. Such agents are usually added to the solution of the polymer and become incorporated into the filaments during the dry spinning step. However, lubricating oils, such as silicone oil can also be applied to the surface of the filaments after the filaments are dry spun.

The barium sulfate additive can be incorporated into the filaments in the same manner as the other additives. The concentration of barium sulfate is typically in the range of 0.3–5% by weight of the spandex polymer. Although various types and grades of barium sulfate particles are known, such as barites or barytes ore, chemically pure barium sulfate, blanc fixe and the like, only barium sulfate having an isoelectric point in the range of 0–4 and having a mean particle size of 0.7–1.0 micron is intended for use in the spandex of this invention. Barium sulfate particles with an isoelectric point in the range of 1–2.5 are preferred.

The particular barium sulfate suited for use in the present invention represents a small fraction of all the barium sulfates that are available commercially. Natural barium sulfate, the mined ore (also known as "barite" or "barytes"), contains several colored impurities. Some of these impurities can be removed by beneficiation of the ore through washing, tabling, jigging or flotation. Chemically pure barium sulfate is also available for chemical reaction purposes. Still another commercially available barium sulfate is precipitated barium sulfate, also known as blanc fixe. Blanc fixe usually is prepared by mixing aqueous solutions of barium sulfide and sodium sulfate under controlled conditions in order to produce a precipitate of uniform particles of pigmentary fineness.

Surprisingly, only those barium sulfate particles which have an isoelectric point of no greater than about 4 (e.g., only some of the blanc fixe grades) fall within the present invention. These particular blanc fixe particles were unexpectedly better than all the others in reducing the tackiness of dry-spun spandex and in providing more efficient operation of the dry-spinning process. With regard to the process, when barium sulfate particles having isoelectric points in accordance with the invention were employed, the barium sulfate particles were well dispersed and did not form agglomerates in the polymer solution; screens and filters operated longer before needing shutdown and cleaning; and even more surprisingly, the solvent content of the filaments leaving the spin shaft was decreased. In addition, spandex yarns containing barium sulfate particles of 0–4 isoelectric point, when wound up into yarn supply packages, permitted satisfactory removal of all the yarn from the package. In contrast, conventional spandex yarn packages having no barium sulfate particles in the filaments usually cannot be totally removed from the package. The portion of the wound-up yarn that is closest to the central cylindrical member of the yarn package usually cannot be removed satisfactorily from the package, which results in about 6% of the total yarn in the package being wasted.

The table below lists the isoelectric point and mean particle size of a selected representative group of commercial barium sulfate powders where IEP means isoelectric point and d50 is the mean particle size in microns. The test methods used for determination of the listed characteristics are described hereinafter. Each of the commercial barium sulfate powders are designated herein by a Roman numeral and identified as follows:

I. Micro grade, blanc fixe, manufactured by Sachtleben of Duisber-Hamburg, Germany II. "F" grade, blanc fixe, manufactured by Sachtleben III. "N" grade, blanc fixe, manufactured by Sachtleben IV. Manufactured by Janssen Chimica, Spectrum Chemical Manufacturing of New Brunswick, N.J.

V. Technical grade powder made by precipitation by Barium & Chemicals, Inc. of Steubenville, Ohio VI. Certified chemically pure, B68–500, sold by Fisher Scientific Company of Pittsburg, Pa.

Barium Sulfate Powder Characteristics

| Type | IEP | d50 |
|---|---|---|
| I | 1 | 0.7 |
| II | 1.4 | 1.0 |
| III | 9.5 | 3.5 |
| IV | 9.5 | 1.4 |
| V | 9.5 | 3.7 |
| VI | 9.5 | 2.5 |

As can be seen from the table, only Type I and Type II barium sulfates are within the present invention.

When polymer solutions containing barium sulfate particles in accordance with the invention were dry spun through orifices, the resulting spandex had rough surfaces and exhibited the lowest tackiness of all the tested barium sulfate powders. While not wishing to be bound by theories related to the unexpected advantages obtained when using Types I and II barium sulfate, it is believed that surface roughness may play an important role in retaining lubricant on the surface of the spun filament and maintaining low tackiness by permitting surface lubricants to be retained on or near the surface of the filaments. That the lubricating oil is on the surface of spandex according to the invention was inferred from tests in which the temperature of spandex samples containing different kinds of barium sulfate powder was raised at 10° C./min and the gases released from the samples were analyzed. Silicone lubricating oils from spandex samples of the invention were detected at temperatures as low as 150° C., indicating that the oil was probably on the surface. In contrast, samples of spandex outside the invention, for example samples containing Type III barium sulfate, or no barium sulfate at all, did not show any release of lubricating oil until a temperature was reached that was close to the decomposition temperature of the spandex (i.e., 260° C.).

Preferred spandex of the invention has a "roughness parameter" (defined hereinafter) that is greater than 75, and most preferably in the range of 10–200.

Figure 7:
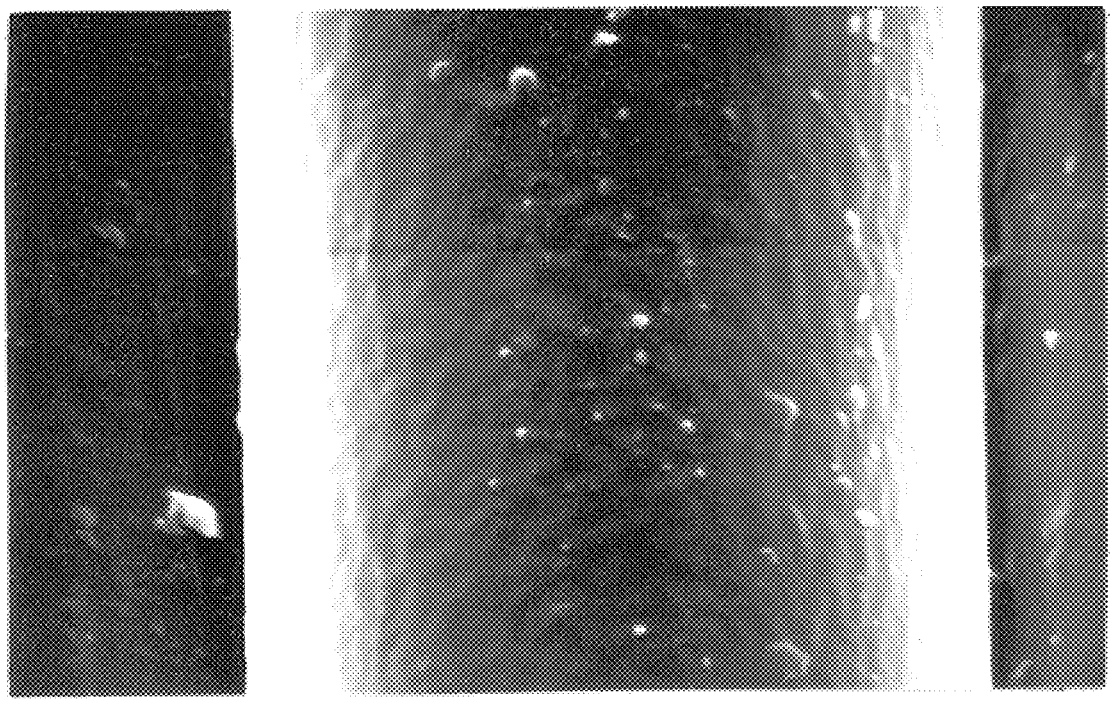
FIG. 7 is a micrograph of a spandex containing no barium sulfate particles. Each micrograph is at a magnification of approximately 2000 and was prepared using a Phillips 515 SCM with EDAX 900 (EDSUNIT) scanning electron microscope operating at about 25 Kv.

In the Figures, the surface character of various spandex samples is apparent. The micrographs of FIGS. 1–6 are of spandex samples containing 1.5% (by weight of the spandex) of Types I through VI barium sulfate, respectively. FIG. 7 is of spandex containing no barium sulfate. On a scale of 1 for a very smooth surface, 2 for a smooth surface, 3 for a rough surface and 4 for a very rough surface, the Figures show the following:

| Figure Number | $BaSO_4$ Type | Surface Classification |
|---|---|---|
| 1 | I | 4 |
| 2 | II | 4 |
| 3 | III | 2.5 |
| 4 | IV | 2.5 |
| 5 | V | 1 |
| 6 | VI | 1 |
| 7 | none | 2 |

The following test procedures were used for measuring various characteristics of the spandex described above and in the Examples below.

Isoelectric point determinations were made with conventional instruments. The isoelectric point is defined as the concentration of hydrogen ions and other ions, usually expressed as a pH, at which the particles have no net charge and the zeta potential is zero. The procedure was as follows. A 20-gram sample of barium sulfate powder in 200 ml of a 0.001N potassium nitrate solution was titrated with 3M potassium hydroxide or 2M nitric acid (depending on whether acid or base was needed for the titration). Prior to the titration, the sample was thoroughly dispersed in the liquid by means of a sonic mixer (Sonicator Model W-385, Heat Systems-Ultrasonics Corp. of Farmingdale, N.Y.). The titration was performed with the sample being stirred constantly. A potentiometric titration meter (ESA-8000 System Model MBS-8000, Matec Applied Science, Inc. of Hopkinton, Mass.) was employed for the titration.

To measure sizes of barium sulfate particles, a laser light scattering instrument (Micro-Trac FRA, full range analyzer, Leeds & Northrup, St. Petersburg, Fla.) was used. Sonically dispersed samples were employed. Each sample was 0.8–2.0 grams of the particles in 80 ml of deionized water which contained 10 drops of "DARVON C" dispersant (R. T. Vanderbilt Chemical of Norwalk, Conn.). At least three samples of each material were analyzed to obtain average particle size and particle size distributions.

A "Roughness Parameter" of spandex, R, is defined herein as $$R=1000\ BET/P$$

wherein BET is the spandex surface area in square meters/gram and P is the average pore size of the spandex in Angstroms. The surface area of spandex was determined from nitrogen adsorption measurements in accordance with the method of Baunner, Emmet and Teller (BET). The measurements were made with a Model 2100 Surface Area and Pore Volume Analyzer (Micrometrics Instruments Corp. of Norcross, Ga.). To prepare the test samples, the filaments were conditioned for about 10 hours under a vacuum of about 0.025 mm of mercury while at a temperature of about 120° C. During the testing the instrument automatically measures at least 21 points during each adsorption-desorption cycle. From these data, the BET surface area, individual pore sizes, and average pore size, P, were calculated. The surface roughness parameter, R, of the spandex was then computed.

To determine the temperatures at which silicone lubricating oil was released from a spandex surface, a thermogravimetric analyzer was employed to raise the temperature of spandex samples at a rate of 10° C./min, with the sample being flushed by a 100-cc/min flow of nitrogen. The flushed gas was passed through a fully insulated tube to a Fourier Transform Infra-red Analyzer. The time at which the infra-red analyzer detected the presence of silicone oil in the nitrogen gas was correlated with the temperature of the sample when the oil was evolved from the sample.

Over-end take-off tension, a measure of the tackiness of a spandex yarn, was determined in accordance with the procedure disclosed in Hanzel et al, U.S. Pat. No. 4,296,174, column 4, lines 20–45, with reference to FIG. 6 of the patent, which disclosure is hereby incorporated by reference. In accordance with this technique, measurements were made of the average tension required to remove a 183-meter sample of spandex yarn from a supply package of the yarn at a delivery rate of 45.7 meters per minute. During each test, the number of tension transients of greater than 0.6 cN was counted with an electronic counter in which the 0.6-cN value was pre-set. During each test about 4000 individual tension measurements are counted.

Strength and elastic properties of the spandex were measured in accordance with the general method of ASTM D 2731–72. Three filaments, a 2-inch (5-cm) gauge length and a zero-to-300% elongation cycle were used for each of the measurements. The samples were cycled five times at an constant elongation rate of 800% per minute and then held at the 300% extension for half a minute after the fifth extension. "Load power" is reported herein in deciNewtons/tex and was the stress measured at a given extension during the first load cycle. "Unload Power" is reported herein in deciNewtons/tex and was the stress measured at a given extension during the fifth unload cycle. Percent elongation at break was measured on the sixth extension cycle. Percent set also was measured on samples that have been subjected to five 0–300% elongation-and-relaxation cycles. The percent set ("% S") was then calculated as $\% S=100(L_f-L_0)/L_0$, where $L_0$ and $L_f$ are respectively the filament length, when held straight without tension, before and after the five elongation/relaxation cycles.

EXAMPLES

The results reported in these examples are believed to be representative but do not constitute all the runs involving the indicated ingredients.

In the examples, spandex samples made with barium sulfate according to the invention are shown to be significantly less tacky than similar comparison spandex samples made with no barium sulfate additive or made with barium sulfate powders that are outside the invention.

Example I

Spandex samples were prepared with a commercial spandex, "LYCRA" Type 146C, to which 1.5% barium sulfate was added. For comparison samples, the barium sulfate was either omitted or had an isoelectric point outside the range required by the invention.

For each sample, the polymer for the spandex was made from a capped glycol, which was the reaction product of P04G and MDI prepared with a capping ratio (i.e., the molar ratio of MDI to P04G) of 1.63 and having an NCO content of 2.40 weight %. % NCO is the unreacted isocyanate concentration in a capped prepolymer, based on the total weight of the capped glycol and any unreacted isocyanate moieties from the capping reaction. % NCO was determined by measurements made according to the method of Siggia, "Quantitative Organic Analysis Via Functional Group", 3rd edition, Wiley & Sons, New York, pages 559–561, (1963). The capped glycol was chain extended with a 90/10 diamine mixture of EDA/MPMD. DEA was employed as a chain terminator. The polymer was dissolved in DMAC to provide a solution having 36.8% solids. 1.5% "CYANOX"-1790 antioxidant, 2% "METHACROL"-2138, and 0.6% silicone oil (based on the weight of the polymer) were added to the solution.

The solution described in the preceding paragraph was dry spun into coalesced 4-filament 44-dtex yarns (or 2-filament 22-dtex yarns) in a conventional apparatus. The solution was metered through spinneret orifices into a spin shaft to form filaments. A co-current flow of nitrogen gas was supplied to the shaft at a temperature of 420° C., which resulted in a temperature of 220° at the half-way point through the shaft. The DMAc vapors exited through a pipe in a side wall near the bottom of the shaft. The filaments were false-twisted by jets at the bottom of the shaft to cause groups of filaments to coalesce into single threadlines. A counter current flow of nitrogen, which was supplied at 135° C. near the bottom of the shaft, combined with the exiting DMAc. The coalesced multi-filament threadlines exited through the bottom of the shaft. A silicone oil finish lubricant was applied to the threadlines by a kiss roll applicator, to provide an add-on of about 3.5% based on the weight of the threadline. Unless indicated otherwise, the yarn was then wound up at a speed of about 840 meters per minute.

Barium sulfate was added to the polymer solution as follows. An 11.4% solution of polymer in DMAc was prepared by diluting 450 parts of polymer solution in 1000 parts of DMAc and then adding 1050 parts (by weight) of barium sulfate particles to the diluted solution with thorough mixing. The resulting slurry was then passed through a sandgrinder to break up any agglomerates that may have formed. The concentration of the barium sulfate in the slurry was 42%. The barium sulfate slurry was then metered to the polymer solution that already contained the other additives at a rate to provide a 1.5% concentration of barium sulfate in the polymer (based on total weight of polymer).

Table 1 below summarizes the measured characteristics of some of the spandex samples made with different kinds (or no) barium sulfate additive.

TABLE 1

| $BaSO_4$ | | Spandex Surface | | | |
|---|---|---|---|---|---|
| Type | IEP | Mean Pore Size (Anstroms) | BET $m^2/g$ | R | class |
| I | 1.0 | 28 | 3.9 | 139 | 4 |
| | 1.0 | 13 | 2.2 | 169 | 4 |
| II | 1.4 | 100 | 0.025 | 0.25 | 4 |
| III | 9.5 | 70 | 0.042 | 0.66 | 2.5 |
| IV | 9.5 | 50 | 0.189 | 3.77 | 2.5 |
| V | 9.5 | 52 | 0.162 | 3.13 | 1 |
| VI | 9.5 | 72 | 0.129 | 1.78 | 1 |
| None | — | 134 | 0.104 | 0.8 | 2 |

Example II

Physical properties of 44-dtex spandex yarns produced by the procedures described above and containing 1.5% micro-grade blanc fixe in accordance with the invention were compared with similarly made yarns having no barium sulfate in them. Table II summarizes the data which show that the presence of barium sulfate does not adversely affect the physical properties of the spandex.

TABLE II

| Barium sulfate | Type I | None |
|---|---|---|
| % E, break elongation | 476 | 483 |
| Tenacity, deciNewton/tex | 0.78 | 0.81 |
| Power, centiNewton/tex | | |
| First cycle load | | |
| LP-100 | 0.083 | 0.084 |
| LP-200 | 0.171 | 0.170 |
| Fifth cycle unload | | |
| UP-100 | 0.015 | 0.015 |
| UP-200 | 0.024 | 0.023 |
| Set, % | 24.2 | 23.2 |

Example III

In this example, three series of runs were made in which spandex yarns were prepared by the procedures of Example I to contain different types of barium sulfate or no barium sulfate. The over-end take-off tension (OETOT) and tension transient characteristics of the yarns were then measured after different periods of room-condition aging. The superiority, in low tackiness, of the spandex yarns made in accordance with the invention with Types I and II barium sulfate was clearly demonstrated by the results summarized in Tables III, IV and V below. The reason for counting transients only >0.6 cN was that when tension transients are less than 0.6 centiNewton, with 40 denier yarns of the type produced in this example, there would be no breaks expected in the spandex during the circular knitting of hosiery.

TABLE III

| $BaSO_4$ | Average OETOT, cN | | | | Number of Transients >0.6 cN | | | |
|---|---|---|---|---|---|---|---|---|
| Type | I | IV | V | None | I | IV | V | None |
| Yarn age | | | | | | | | |
| 8 weeks | 0.13 | 0.25 | 0.22 | 0.38 | 0 | 33 | 0 | 234 |
| 16 weeks | 0.23 | 0.43 | 0.30 | 0.51 | 0 | 608 | 0 | 1100 |
| 21 weeks | 0.41 | 0.52 | 0.54 | 0.95 | 535 | 1510 | 2094 | >4000 |

TABLE IV

| $BaSO_4$ | Average OETOT, cN | | | | Number of Transients >0.6 cN | | | |
|---|---|---|---|---|---|---|---|---|
| Type | I | IV | V | None | I | IV | V | None |
| Yarn age | | | | | | | | |
| 4 weeks | 0.13 | 0.29 | 0.20 | 0.31 | 0 | 177 | 49 | 205 |
| 8 weeks | 0.31 | 0.46 | 0.23 | 0.59 | 9 | 762 | 34 | 1370 |
| 12 weeks | 0.31 | 0.49 | 0.44 | 0.44 | 0 | 534 | 99 | >1490 |

TABLE V

| | Average tension, cN | | Number of Transients >0.6 cN | |
|---|---|---|---|---|
| $BaSO_4$ Type | II | None | II | None |
| Yarn age | | | | |
| 4 weeks | 0.10 | 0.39 | 0 | 59 |
| 8 weeks | 0.20 | 0.44 | 0 | 150 |
| 12 weeks | 0.24 | 0.56 | 0 | 1647 |

We claim:

1. A spandex having a lubricating finish on its surface and barium sulfate particles dispersed within its volume, wherein the barium sulfate particles have an isoelectric point of 0–4 and a mean particle size of 0.7–1.0 micron.

2. The spandex of claim 1 containing barium sulfate particles having an isoelectric point of 1–2.5.

3. The spandex of claim 1 wherein the spandex has surface roughness parameter of at least 75.

4. The spandex of claim 3 containing 0.3–5% by weight, based on the weight of spandex, of barium sulfate wherein the spandex has a surface roughness parameter of 100–200.

5. The spandex of claim 1, wherein the lubricating finish is 1–6% by weight, based on the weight of the spandex, of a polysiloxane.

6. The spandex of claim 1 wound up on a cylindrical member to form a yarn supply package of low tackiness.

7. A process for dry-spinning spandex, wherein a solution of a segmented polyurethane polymer in an organic solvent is mixed with additives and then dry-spun into filaments, wherein at least one of the additives is barium sulfate having an isoelectric point of 0–4 and mean particle size of 0.7–1.0 nm.

* * * * *